US011781844B2

(12) United States Patent
Peery et al.

(10) Patent No.: US 11,781,844 B2
(45) Date of Patent: Oct. 10, 2023

(54) MISSILE COMPONENT ATTACHMENT ASSEMBLY

(71) Applicant: Raytheon Company, Waltham, MA (US)

(72) Inventors: Justin E. Peery, Tucson, AZ (US); Reed W. Nyght, Tucson, AZ (US); Jeremy Bock, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 121 days.

(21) Appl. No.: 17/392,532

(22) Filed: Aug. 3, 2021

(65) Prior Publication Data

US 2023/0043441 A1 Feb. 9, 2023

(51) Int. Cl.
*F42B 33/00* (2006.01)
*F42B 30/08* (2006.01)

(52) U.S. Cl.
CPC ..... *F42B 33/001* (2013.01); *F42B 30/08* (2013.01)

(58) Field of Classification Search
CPC ..... F42B 33/001; F42B 30/08
See application file for complete search history.

(56) References Cited

U.S. PATENT DOCUMENTS 556,461 A * 3/1896 Fellows ..... F42B 33/001 86/38
2,883,930 A 4/1959 Gott et al.
3,117,520 A 1/1964 Kerr et al.
3,648,953 A 3/1972 Polk, Jr.
4,568,041 A 2/1986 Whitham
4,722,496 A 2/1988 Herrmann et al.
5,064,142 A * 11/1991 Lailer, Jr. ..... F42B 10/06 244/3.25
6,315,240 B1 * 11/2001 Rasmussen ..... F42B 10/64 244/3.29

(Continued)

FOREIGN PATENT DOCUMENTS

DE 102018003006 A1 * 10/2019
FR 2657703 A1 * 8/1991

(Continued)

*Primary Examiner* — Jacob J Cigna
(74) *Attorney, Agent, or Firm* — Renner, Otto, Boisselle, & Sklar

(57) ABSTRACT

An attachment assembly includes a conically tapered missile body interface surface of a missile body attachment interface wedged against a conically tapered missile component interface surface of a missile body attachment interface. The missile body attachment interface also includes an engagement rod for locked engagement by a hook of the missile component attachment interface. Specifically, the missile component attachment interface includes an auto-adjusting assembly having a series of pivoting arms connected to a rotatable engagement drive at a first end thereof and a hook at a second end thereof. The auto-adjusting assembly is moveable between a first position and a second position, and between the second position and a third position. The missile component attachment interface includes a pre-loaded over-center mechanism operably coupled to the auto-adjusting assembly and configured to lock the hook in engagement with the engagement rod in the third position.

20 Claims, 5 Drawing Sheets

(56) References Cited

U.S. PATENT DOCUMENTS

| | | | | |
|---|---|---|---|---|
| 6,450,444 | B1 * | 9/2002 | Sorvino | F42B 10/64 244/3.24 |
| 2007/0045466 | A1 * | 3/2007 | Hellis | F42B 10/14 244/3.29 |
| 2008/0006736 | A1 * | 1/2008 | Banks | F42B 10/64 244/3.21 |

FOREIGN PATENT DOCUMENTS

| | | | | |
|---|---|---|---|---|
| GB | 2164612 | A * | 3/1986 | B63G 8/18 |
| KR | 20160092806 | A * | 8/2016 | |

* cited by examiner

MISSILE COMPONENT ATTACHMENT ASSEMBLY

TECHNICAL FIELD

The present disclosure relates generally to missile component attachment assemblies and more particularly to a quick-attaching and auto-adjusting missile component attachment assembly.

BACKGROUND

High performance tactical missiles and other flight weaponry employ a plurality of components, such as missile control surfaces to control performance of the weapon during flight. It is often necessary to have these components attached to the missile on the flight line or in the field due to packaging constraints or other logistical factors. The attachment of these components typically require custom, specialized tools, such as torque wrenches, for ensuring a secure attachment, repeatable torque, and a proper resulting load on the attachment interface. Such tools are not often readily available on the flight line or in the field, making secure attachment, repeatable torque, and proper resulting load difficult and sometimes impossible to achieve.

SUMMARY

To solve the aforementioned problems, a quick-attaching and auto-adjusting attachment assembly for a missile component is described herein. The attachment assembly utilizes a pre-loaded over-center mechanism operably coupled to an auto-adjusting assembly, both of which are integrated in a missile component attachment interface of the attachment assembly. The pre-loaded over-center mechanism and auto-adjusting assembly are configured to securely attach the missile component attachment interface to a missile body attachment interface with a repeatable preloaded torque and a proper resulting load on the attachment assembly. The pre-loaded over-center mechanism and auto-adjusting assembly are configured to be engaged and actuated via a standard, rotatable drive, accessible on the missile component attachment interface. In this manner, the attachment assembly eliminates the need for specialized tools, allowing for standard tools to operate the attachment assembly, and reduces assembly time and effort for assembling missiles on the flight line and in the field.

According to an aspect of this disclosure, an attachment assembly includes a missile body attachment interface including a conically tapered missile body interface surface and an engagement rod. The attachment assembly also includes a missile component attachment interface. The missile component attachment interface includes a conically tapered missile component interface surface configured to be wedged against the conically tapered missile body interface surface. The missile component attachment interface also includes an auto-adjusting assembly having a series of pivoting arms linearly connected to each other. The series of pivoting arms are pivotably connected to a rotatable engagement drive at a first end thereof and a hook at a second end thereof. The auto-adjusting assembly is movable between a first position in which the hook is unengaged with the engagement rod and a second position in which the hook is engaged and unlocked with the engagement rod, and between the second position and a third position in which the hook is engaged and locked with the engagement rod. The missile component attachment interface also includes a pre-loaded over-center mechanism operably coupled to the auto-adjusting assembly and configured to lock the hook in engagement with the engagement rod in the third position.

According to an embodiment of any paragraph(s) of this summary, the missile component attachment interface is a part of a missile control surface.

According to an embodiment of any paragraph(s) of this summary, the missile body attachment interface is a part of a control actuation section (CAS) of a missile body.

According to an embodiment of any paragraph(s) of this summary, the series of pivoting arms include at least two pivoting arms.

According to an embodiment of any paragraph(s) of this summary, the rotatable engagement drive is a ¼ inch drive.

According to an embodiment of any paragraph(s) of this summary, the missile body attachment interface includes a missile body mount and an annular projection projecting away from the missile body mount in a projecting direction.

According to an embodiment of any paragraph(s) of this summary, the conically tapered missile body interface surface is disposed on an inner circumferential side of the annular projection.

According to an embodiment of any paragraph(s) of this summary, the missile component attachment interface also includes a housing in which at least a part of the auto-adjusting assembly and at least a part of the pre-loaded over-center mechanism are housed, and a C-shaped projection projecting away from the housing.

According to an embodiment of any paragraph(s) of this summary, the conically tapered missile component interface surface is disposed on an outer circumferential side of the C-shaped projection.

According to an embodiment of any paragraph(s) of this summary, the housing of the missile component attachment interface includes a pivot pin guide hole along which at least one pivot pin of the series of pivoting arms is configured to slide.

According to an embodiment of any paragraph(s) of this summary, the housing of the missile component attachment interface includes an engagement drive hole for accessing the rotatable engagement drive from an exterior of the housing.

According to an embodiment of any paragraph(s) of this summary, the missile body attachment interface includes an engagement rod support structure arranged concentrically within the annular projection and projecting away from the missile body mount in the projecting direction.

According to an embodiment of any paragraph(s) of this summary, the engagement rod support structure is configured to support the engagement rod such that it extends perpendicular to the projecting direction.

According to an embodiment of any paragraph(s) of this summary, the missile body attachment interface includes a stabilizing key projecting perpendicularly out from the engagement rod support structure.

According to an embodiment of any paragraph(s) of this summary, the housing of the missile component attachment interface includes a keyhole into which the stabilizing key of the missile body attachment interface fits when the missile component attachment interface is interfaced with the missile body attachment interface.

According to another aspect of this disclosure, a missile component attachment interface of a missile component for attachment to a missile body attachment interface of a missile body includes a conically tapered missile component interface surface configured to be wedged against a conically tapered missile body interface surface of the missile body attachment interface. The missile component attachment interface also includes an auto-adjusting assembly having a series of pivoting arms linearly connected to each other. The series of pivoting arms are pivotably connected to an engagement drive at a first end thereof and a hook at a second end thereof. The auto-adjusting assembly is movable between a first position in which the hook is unengaged with an engagement rod of the missile body attachment interface and a second position in which the hook is engaged and unlocked with the engagement rod, and between the second position and a third position in which the hook is engaged and locked with the engagement rod. The missile component attachment interface also includes a pre-loaded over-center mechanism operably coupled to the auto-adjusting assembly and configured to lock the hook in engagement with the engagement rod in the third position.

According to another aspect of this disclosure, a method of attaching a missile component to a missile body is described. The missile body includes a missile body attachment interface having a conically tapered missile body interface surface and an engagement rod. The missile component includes a missile component attachment interface having a conically tapered missile component interface surface, an auto-adjusting assembly having a series of pivoting arms linearly connected to each other, the series of pivoting arms pivotably connected to an engagement drive at a first end thereof and a hook at a second end thereof, and a pre-loaded over-center mechanism operably coupled to the auto-adjusting assembly. The method includes the step of wedging the conically tapered missile component interface surface against the conically tapered missile body interface surface. The method also includes the step of moving the auto-adjusting assembly of the missile component attachment interface from a first position in which the hook is unengaged with the engagement rod, to a second position in which the hook is engaged and unlocked with the engagement rod. The method also includes the step of further moving the auto-adjusting assembly from the second position to a third position in which the hook is engaged and locked with the engagement rod. The further moving includes locking, with the pre-loaded over-center mechanism, the hook in engagement with the engagement rod in the third position.

According to an embodiment of any paragraph(s) of this summary, the moving the auto-adjusting assembly of the missile component attachment interface from the first position to the second position includes rotating the rotatable engagement drive in a first direction.

According to an embodiment of any paragraph(s) of this summary, the further moving the auto-adjusting assembly from the second position to the third position includes further rotating the rotatable engagement drive in the first direction.

According to an embodiment of any paragraph(s) of this summary, a method of detaching the missile component attached to the missile body with the method of attaching the missile component to the missile body includes reversing, by rotating the engagement drive in a second direction opposite the first direction, the auto-adjusting assembly from the third position to the second position. The method of detaching also includes further reversing, by further rotating the engagement drive in the second direction, the auto-adjusting assembly from the second position to the first position. The reversing includes unlocking, with the pre-loaded over-center mechanism, the hook from engagement with the engagement rod in the third position.

The following description and the annexed drawings set forth in detail certain illustrative embodiments described in this disclosure. These embodiments are indicative, however, of but a few of the various ways in which the principles of this disclosure may be employed. Other objects, advantages and novel features will become apparent from the following detailed description when considered in conjunction with the drawings.

BRIEF DESCRIPTION OF DRAWINGS

The annexed drawings show various aspects of the disclosure.

DETAILED DESCRIPTION

According to a general embodiment, a quick-attaching and auto-adjusting attachment assembly includes a missile body attachment interface and a missile component attachment interface configured to be interfaced and attached to each other. The missile body attachment interface includes a conically tapered missile body interface surface onto which a conically tapered missile component interface surface is configured to be wedged against. The missile body attachment interface also includes an engagement rod for locked engagement by a hook of the missile component attachment interface. Specifically, the missile component attachment interface includes an auto-adjusting assembly having a series of pivoting arms connected to a rotatable engagement drive at a first end thereof and the hook at a second end thereof. The auto-adjusting assembly is moveable between a first position in which the hook is unengaged with the engagement rod and a second position in which the hook is engaged and unlocked with the engagement rod. The auto-adjusting assembly is also moveable between the second position and a third position in which the hook is engaged and locked with the engagement rod. The missile component attachment interface includes a pre-loaded over-center mechanism operably coupled to the auto-adjusting assembly and configured to lock the hook in engagement with the engagement rod in the third position.

Figure 1:
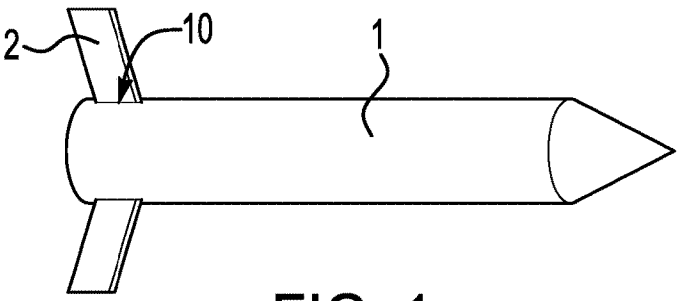
FIG. 1 is a schematic view of a missile body having a missile component attached thereto.
Figure 2:
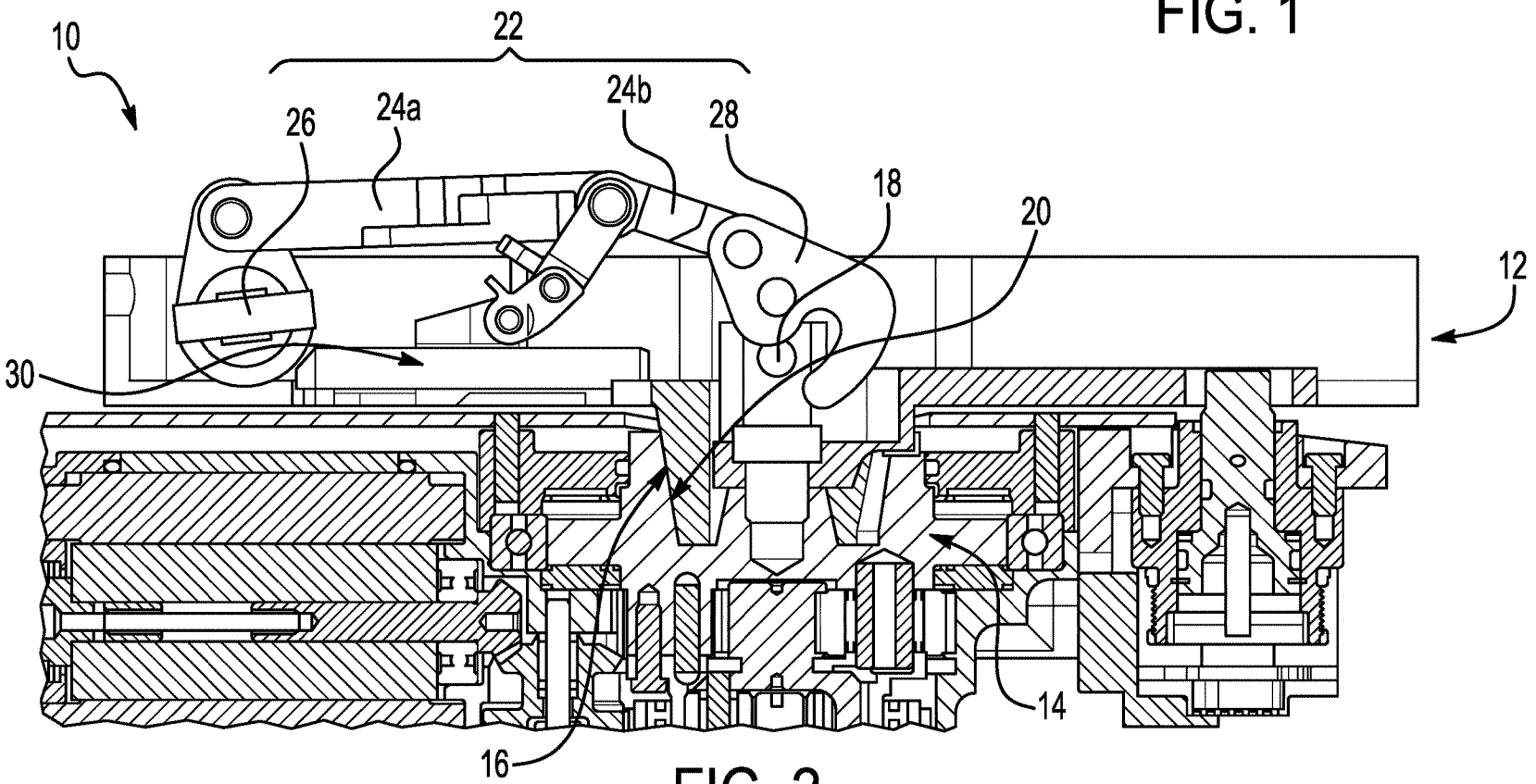
FIG. 2 is a cross-sectional view of an attachment assembly in an unattached state.
Figure 3:
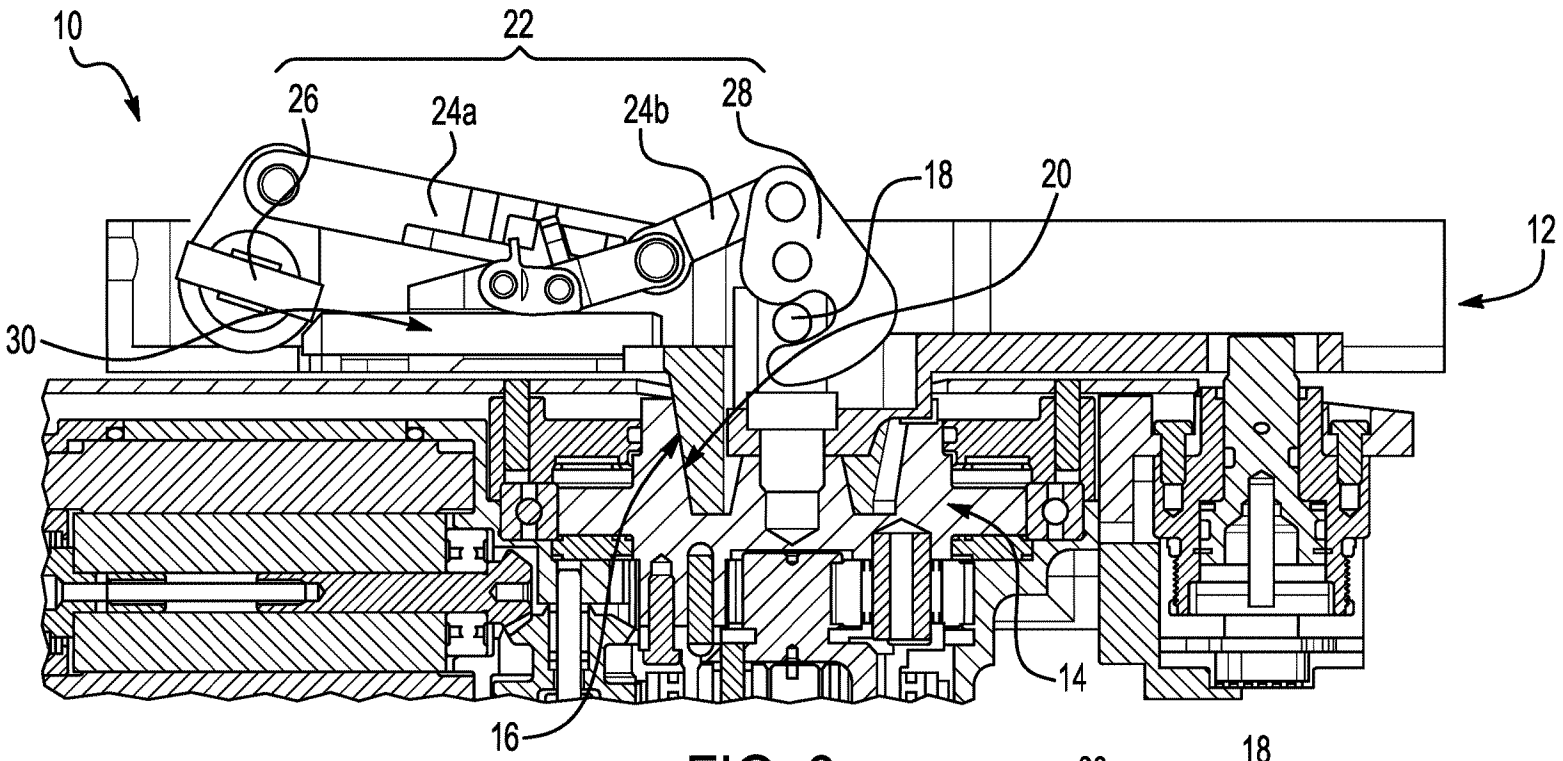
FIG. 3 is a cross-sectional view of the attachment assembly of FIG. 2 in an attached state.

FIG. 1 depicts a general schematic of a missile body 1 having a missile component 2, such as a missile control surface, attached thereto. The missile component 2 is attached to the missile body 1 with a quick-attaching and auto-adjusting attachment assembly 10 at the interface between the missile component 2 and the missile body 1. With specific reference to FIGS. 2 and 3, the quick-attaching and auto-adjusting attachment assembly 10 is depicted in both an unattached state (FIG. 2) and an attached state (FIG. 3). As described above, the attachment assembly 10 includes a missile component attachment interface 12 and a missile body attachment interface 14. The missile component attachment interface 12 is configured to be interfaced with and attached to the missile body attachment interface 14 in the attachment assembly 10 without the need for any specialized tools. As non-limiting examples, the missile component attachment interface 12 may be a part of a missile control surface and the missile body attachment interface 14 may be a part of a control actuation section (CAS) of a missile body. It is understood, however, that the missile component attachment interface 12 and the missile body attachment interface 14 of the attachment assembly 10 may be a part of any other suitable missile component and missile body, respectively.

The missile component attachment interface 12 includes an auto-adjusting assembly 22 having a series of pivoting arms 24*a-b* linearly connected to each other. The series of pivoting arms 24*a-b* may include at least two pivoting arms 24*a-b*. Each of the plurality of the pivoting arms 24*a-b* may have a length in the range of 1.27 cm (0.5 in) to 5.08 cm (2.0 in), 1.78 cm (0.70 in) to 3.81 cm (1.5 in), or 1.91 cm (0.75 in) to 2.54 cm (1.0 in). The series of pivoting arms 24*a-b* are pivotally connected to a rotatable engagement drive 26 at a first end thereof and a hook 28 at a second end thereof. The hook 28 may have a length in the range of 2.54 cm (1.0 in) to 5.08 cm (2.0 in), or 2.69 cm (1.05 in) to 3.81 cm (1.5 in). As a non-limiting example, the rotatable engagement drive 26 may be any standard rotatable drive such as, for example, a ¼ inch drive. It will be understood, however, that the rotatable engagement drive 26 may be any other standard drive operable with standard tools. The missile body attachment interface 14 includes an engagement rod 18 which is engageable by the hook 28 of the auto-adjusting assembly 22 of the missile component attachment interface 12. The various parts of the missile component attachment interface 12 and the missile body attachment interface 14 may be made of, for example, high strength steel such as 17-4 PH, 13-8 PH, SS 303 or SS 304. It is understood, however, that these specific materials are provided as non-limiting examples and that other materials may be used depending on the application and environment in which the interfaces are used.

Specifically, as will be described in more detail below with additional reference to FIGS. 6-9, the auto-adjusting assembly 22 is moveable between a first position in which the hook 28 is unengaged with the engagement rod 18 (depicted in FIGS. 2, 6, and 7) and a second position in which the hook 28 is engaged and unlocked with the engagement rod 18 (depicted in FIG. 8). The auto-adjusting assembly 22 is also moveable between the second position and a third position in which the hook 28 is engaged and locked with the engagement rod 18 (depicted in FIGS. 3 and 9). The missile component attachment interface 12 includes a pre-loaded over-center mechanism 30 operably coupled to the auto-adjusting assembly 22 and configured to lock the hook 28 in engagement with the engagement rod 18 in the third position.

Figure 4:
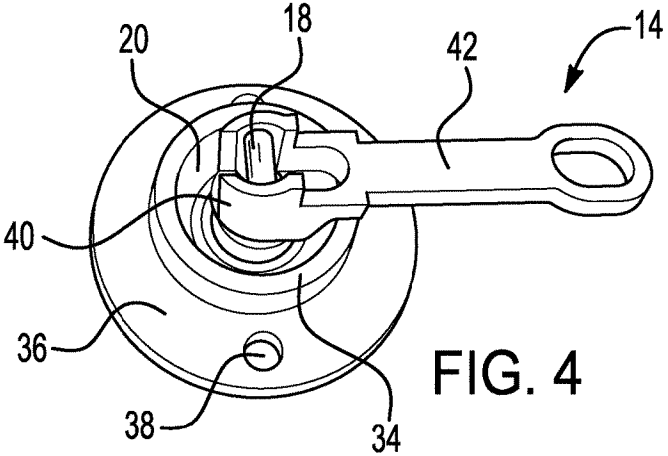
FIG. 4 is a perspective view of a missile body attachment interface of the attachment assembly of FIGS. 2 and 3.

With additional reference to FIGS. 4 and 5, the configuration of the missile body attachment interface 14 (FIG. 4) and the missile component attachment interface 12 (FIG. 5) will be described in more detail. The missile body attachment interface 14 includes a conically tapered missile body interface surface 20 and the missile component attachment interface 12 of the attachment assembly 10 includes a conically tapered missile component interface surface 16 configured to be wedged against the conically tapered missile body interface surface 20 when the missile component attachment interface 12 and the missile body attachment interface 14 are interfaced with each other, as in FIGS. 2 and 3. The missile body attachment interface 14 may include a missile body mount 36 configured to attach the missile body attachment interface 14 to a missile body. The missile body attachment interface 14 may be mounted to the missile body with, for example, screws or any other suitable fixing means. Therefore, the missile body mount 36 may include screw holes 38. Alternatively, the missile body attachment interface 14 may be integral with the missile assembly. It will be understood, however, that the missile body attachment interface 14 may be mounted to the missile body in any other suitable manner, depending on the application and environment in which it is used.

The missile body attachment interface 14 may also include an annular projection 34 projecting away from the missile body mount 36 in a projecting direction. The conically tapered missile body interface surface 20 may be disposed on an inner circumferential side of the annular projection 34. Arranged concentrically within the annular projection 34 may be an engagement rod support structure 40, also projecting away from the mount 36 in the projecting direction. The engagement rod support structure 40 is configured to support the engagement rod 18 within the missile body attachment interface 14 such that the engagement rod 18 extends perpendicular to the projecting direction so as to be engageable by the hook 28 of the missile component attachment interface 12. The engagement rod support structure 40 may have a diameter of about 1.524 cm (0.6 in). The engagement rod 18 may have a diameter of about 0.411 cm (0.16 in). The missile body attachment interface 14 may additionally include a stabilizing key 42 projecting perpendicularly out from the engagement rod support structure 40.

Figure 5:
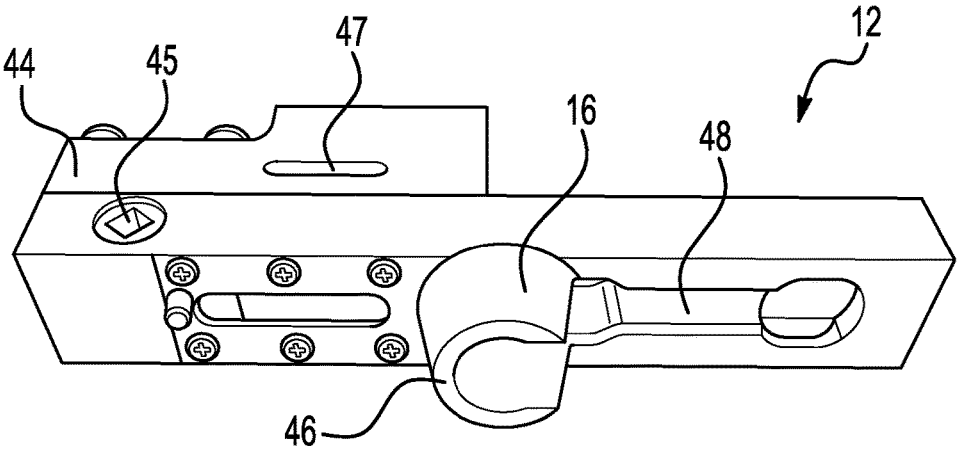
FIG. 5 is a perspective view of a missile component attachment interface of the attachment assembly of FIGS. 2 and 3.

As depicted in FIG. 5, the missile component attachment interface 12 may include a housing 44 in which at least a part of the auto-adjusting assembly 22 (FIGS. 2 and 3) and at least a part of the pre-loaded over-center mechanism 30 (FIGS. 2 and 3) are housed. For example, at least part of the series of pivoting arms 24*a-b* (FIGS. 2 and 3) and the hook 28 (FIGS. 2 and 3) may extend out of the housing so that the hook 28 can rotate and engage the engagement rod 18 (FIGS. 2 and 3) of the missile body attachment interface 14 (FIGS. 2 and 3). The rotatable engagement drive 26 is accessible from an exterior of the housing 44 via an engagement drive hole 45 formed in the housing 44. The housing may additionally include a linear pivot pin guiding slot 47 along which at least one pivot pin of the series of pivoting arms 24*a-b* may slide.

The missile component attachment assembly 12 may include a C-shaped projection 46 projecting away from the housing 44 toward the annular projection 34 of the missile body attachment assembly 14 when interfaced therewith. The conically tapered missile component interface surface 16 may be disposed on an outer circumferential side of the C-shaped projection 46. When the missile component attachment assembly 12 is interfaced with the missile body attachment interface 14, the C-shaped projection 46 is configured to fit within the annular projection 34 of the missile body attachment interface 14 such that the conically tapered missile component interface surface 16 wedges against the conically tapered missile body interface surface 20. When interfaced accordingly, the engagement rod support structure 40 and engagement rod 18 extend centrally within the C-shaped projection 46 so as to be engageable by the hook 28. The housing 44 of the missile component attachment interface 12 also includes a keyhole 48 into which the key 42 of the missile body attachment interface 14 fits when the missile component attachment interface 12 interfaces with the missile body attachment interface 14. When interfaced accordingly, the key 42 fit within the keyhole 48 prevents unwanted lateral movement of the attachment assembly 10 and keeps the attachment assembly 10 aligned properly. It is understood, however, that the key 42 and associated keyhole 48 are provided as a non-limiting example of a way to prevent rotation of the missile component attachment interface 12, and that such a result may be accomplished in any other suitable manner, such as with an attachment of a fairing, cover or other component.

Figure 6:
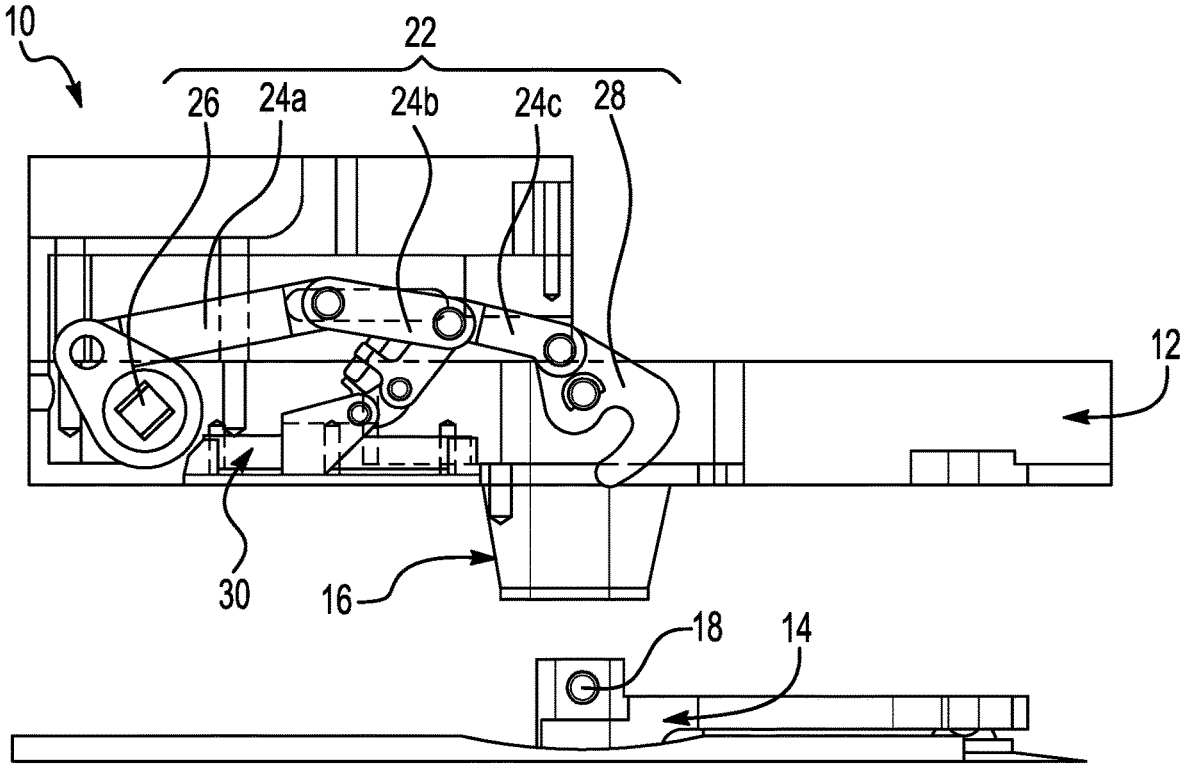
FIG. 6 is a cross-sectional diagrammatic view of an attachment assembly having a missile component attachment interface and a missile body attachment interface spaced apart from each other and an auto-adjusting assembly in a first position.
Figure 7:
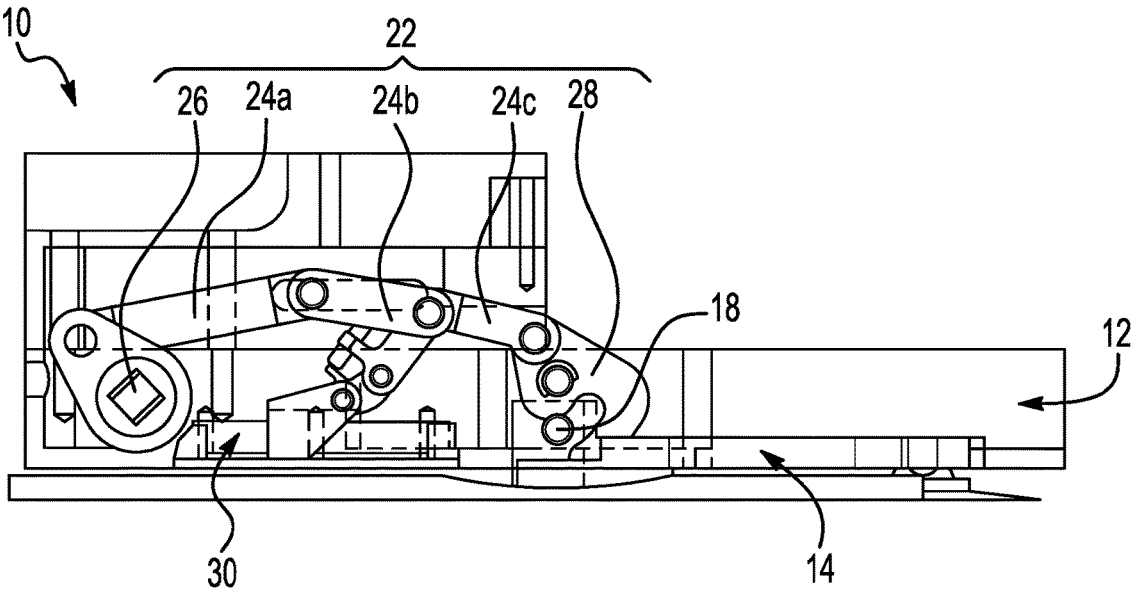
FIG. 7 is a cross-sectional diagrammatic view of the attachment assembly of FIG. 6 having the missile component attachment interface and the missile body attachment interface interfaced with each other and the auto-adjusting assembly in the first position.

Turning now to FIGS. 6-9, the movement of the auto-adjusting assembly 22 from the first position to the second position and from the second position to the third position will be described. FIGS. 2, 6, and 7 depict the auto-adjusting assembly 22 in the first position. Specifically, FIG. 6 depicts the missile component attachment interface 12 and the missile body attachment interface 14 spaced apart from each other before they are interfaced with each other, while FIGS. 2 and 7 depict the missile component attachment interface 12 interfaced with the missile body attachment interface 14. In the first position of the auto-adjusting assembly 22, whether the missile component attachment interface 12 is spaced apart from or interfaced with the missile body attachment interface 14, the hook 28 is unengaged with the engagement rod 18 of the missile body attachment interface 14.

Figure 8:
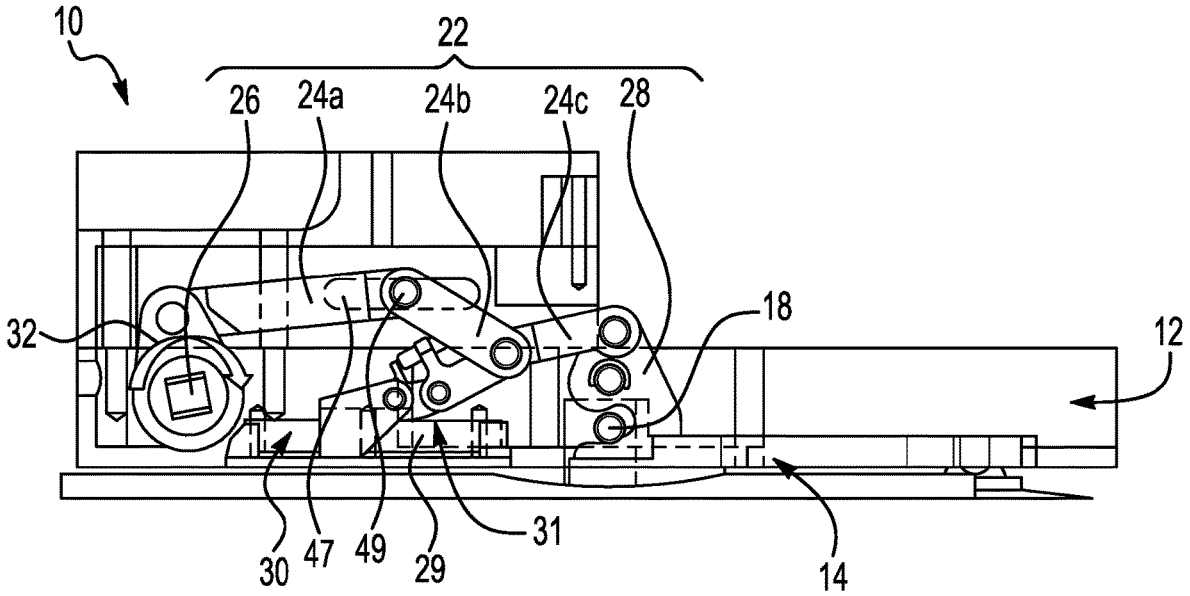
FIG. 8 is a cross-sectional diagrammatic view of the attachment assembly of FIGS. 6 and 7 having the missile component attachment interface and the missile body attachment interface interfaced with each other and the auto-adjusting assembly in a second position.

Upon rotation of the rotatable engagement drive 26 in a first direction 32, the auto-adjusting assembly 22 moves from the first position (FIGS. 2, 6, and 7) to the second position (FIG. 8). As depicted in FIG. 8, the rotatable engagement drive 26 has been rotated in the first direction 32. Rotating the rotatable engagement drive 26 in the first direction 32 causes the series of pivoting arms 24*a-b* to pivot relative to each other such that the hook 28 rotates to engage the engagement rod 18. For example, at least one pivot pin 49 in the series of pivoting arms 24*a-c* may be configured to slide along the linear guiding slot 47 formed in the housing 44 such that the series of pivoting arms 24*a-c* pivot relative to each other to properly rotate the hook 28 to engage the engagement rod 18. When the hook 28 engages the engagement rod 18 in the second position, a cam 31 on the pre-loaded over-center mechanism 30 engages a slide 29 on the pre-loaded over-center mechanism 30 such that any further movement of the auto-adjusting assembly 22 will cause the pre-loaded over-center mechanism 30 to apply a pre-load on the hook 28.

Figure 9:
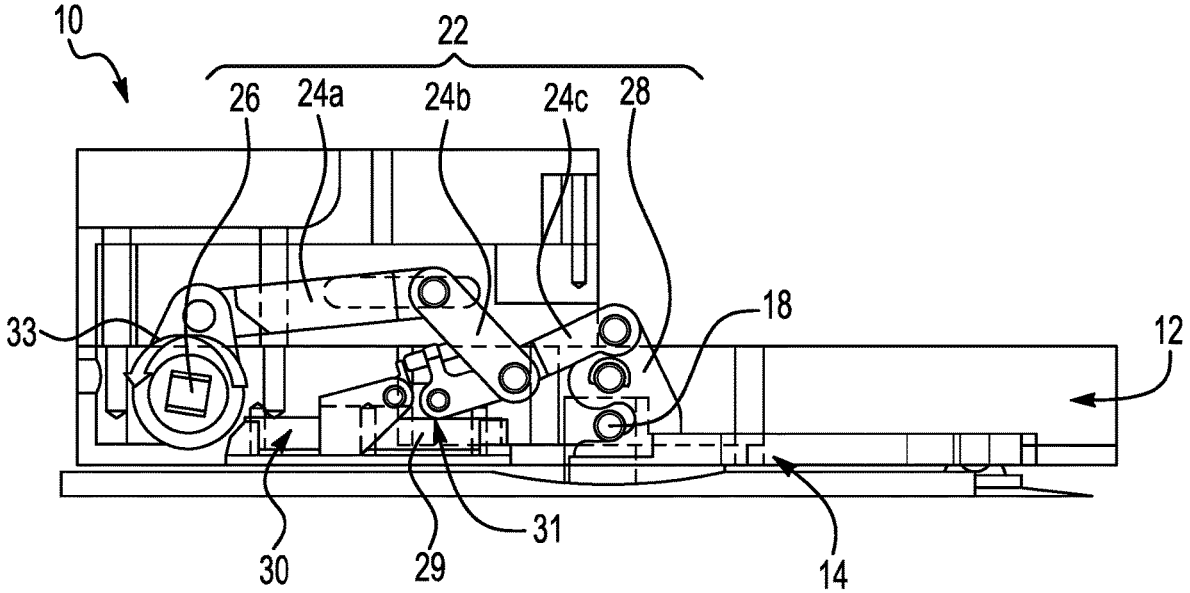
FIG. 9 is a cross-sectional diagrammatic view of the attachment assembly of FIGS. 6-8 having the missile component attachment interface and the missile body attachment interface interfaced with each other and the auto-adjusting assembly in a third position.

Upon further rotation of the rotatable engagement drive 26 in the first direction 32, the auto-adjusting assembly 22 moves from the second position (FIG. 8) to the third position (FIG. 9). As depicted in FIG. 9, the rotatable engagement drive 26 has been further rotated in the first direction 32. Further rotating the rotatable engagement drive 26 in the first direction 32 causes the series of pivoting arms 24*a-c* to further pivot relative to each other to engage the pre-loaded over-center mechanism 30 to lock the hook 28 in engagement with the engagement rod 18. The pre-loaded over-center mechanism 30 in the missile component attachment interface 12 is preset for a desired load on the attachment interface 10 prior to being engaged. When the auto-adjusting assembly 22 moves from the second position to the third position, the pre-loaded over-center mechanism 30 is engaged, locking the hook 28 in engagement with the engagement rod 18. Specifically, when engaged due to the cam 31 engaged with the slide 29, the pre-loaded over-center mechanism 30 applies the pre-load to the hook 28, which in turn applies the pre-load on the attachment interface 10. The load is repeatable and can be adjusted to a higher or lower value using an adjustment mechanism set screw on the pre-loaded over-center mechanism 30, which forces the cam 31 to engage causing either a higher or lower over center force that results in higher or lower preload based on the setting. The rotatable engagement drive 26 may be rotated between 35 and 45 degrees to accomplish the above.

The above described movement of the auto-adjusting assembly 22 may be reversed to unlock and disengage the hook 28 from the engagement rod 18 by rotating the rotatable drive 26 in a second direction 33 opposite the first direction 32. For example, when in the third position, rotating the rotatable drive 26 in the second direction 33 will cause the pre-loaded over-center mechanism 30 to disengage and unlock the hook 28 from engagement with the engagement rod 18 and move the auto-adjusting assembly 22 from the third position to the second position. Further rotating the rotatable drive 26 in the second direction will cause the series of pivoting arms 24*a*-c to pivot relative to each other such that the hook 28 rotates to disengage the engagement rod 18 and move the auto-adjusting assembly 22 from the second position to the first position. The missile component attachment assembly 12 may then be removed from the missile body attachment assembly 14.

Figure 10:
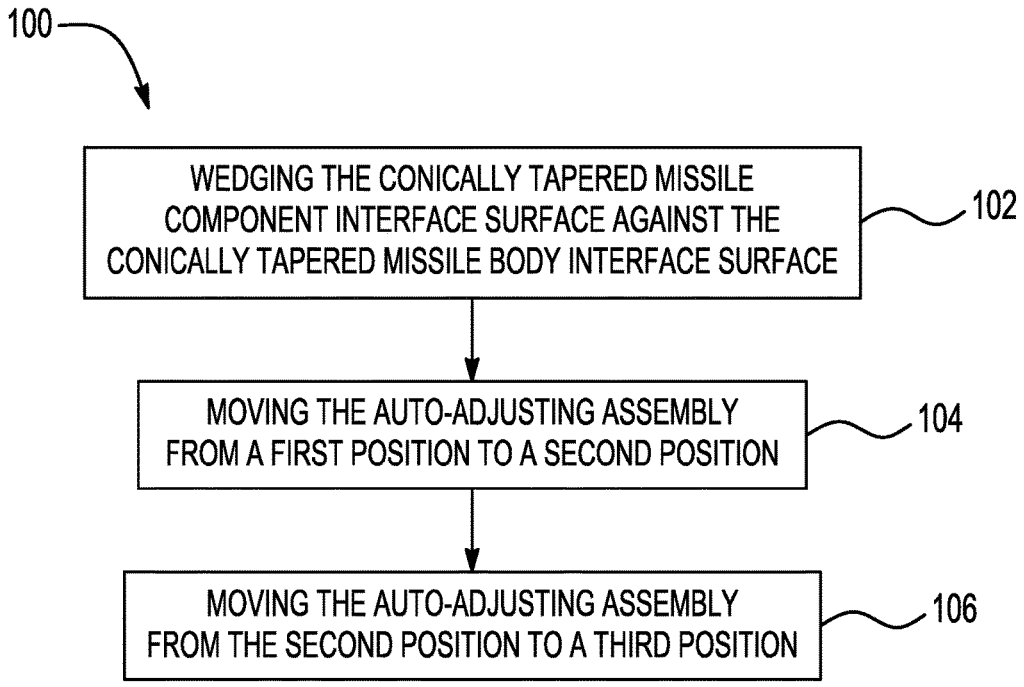
FIG. 10 is a flowchart of a method of attaching a missile component to a missile body.

FIG. 10 depicts a method 100 of attaching a missile component to a missile body using the attachment assembly 10 described herein. The method 100 therefore includes the steps of wedging 102 the conically tapered missile component interface surface against the conically tapered missile body interface surface and moving 104 the auto-adjusting assembly of the missile component attachment interface from a first position to a second position. In the first position, the hook is unengaged with the engagement rod and in the second position, the hook is engaged and unlocked with the engagement rod, as described above. The step of moving 104 the auto-adjusting assembly of the missile component attachment interface from the first position to the second position may include rotating the rotatable engagement drive in a first direction. The method 100 further includes the step of further moving 106 the auto-adjusting assembly from the second position to a third position. In the third position, the hook is engaged and locked with the engagement rod. The further moving includes locking, with the pre-loaded over-center mechanism, the hook in engagement with the engagement rod in the third position. The further moving the auto-adjusting assembly from the second position to the third position may also include further rotating the rotatable engagement drive in the first direction.

A method of detaching the missile component attached to the missile body according to the above-described method includes reversing the auto-adjusting assembly from the third position to the second position. This includes unlocking, with the pre-loaded over-center mechanism, the hook from engagement with the engagement rod in the third position. The method of detaching further includes further reversing the auto-adjusting assembly from the second position to the first position, where the missile component attachment interface may be removed from the missile body attachment interface.

Although the above disclosure has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments. In addition, while a particular feature may have been described above with respect to only one or more of several illustrated embodiments, such feature may be combined with one or more other features of the other embodiments, as may be desired and advantageous for any given or particular application.

What is claimed is:

1. An attachment assembly, comprising:

a missile body attachment interface including a conically tapered missile body interface surface and an engagement rod;

a missile component attachment interface including:

a conically tapered missile component interface surface configured to be wedged against the conically tapered missile body interface surface;

an auto-adjusting assembly having a series of pivoting arms linearly connected to each other, the series of pivoting arms pivotably connected to a rotatable engagement drive at a first end thereof and a hook at a second end thereof, the auto-adjusting assembly movable between a first position in which the hook is unengaged with the engagement rod and a second position in which the hook is engaged and unlocked with the engagement rod, and between the second position and a third position in which the hook is engaged and locked with the engagement rod; and a pre-loaded over-center mechanism operably coupled to the auto-adjusting assembly and configured to lock the hook in engagement with the engagement rod in the third position.

2. The attachment assembly according to claim 1, wherein the missile component attachment interface is a part of a missile control surface.

3. The attachment assembly according to claim 1, wherein the missile body attachment interface is a part of a control actuation section (CAS) of a missile body.

4. The attachment assembly according to claim 1, wherein the series of pivoting arms include at least two pivoting arms.

5. The attachment assembly according to claim 1, wherein the rotatable engagement drive is a ¼ inch drive.

6. The attachment assembly according to claim 1, wherein the missile body attachment interface includes a missile body mount and an annular projection projecting away from the missile body mount in a projecting direction.

7. The attachment assembly according to claim 6, wherein the conically tapered missile body interface surface is disposed on an inner circumferential side of the annular projection.

8. The attachment assembly according to claim 1, wherein the missile component attachment interface includes:

a housing in which at least a part of the auto-adjusting assembly and at least a part of the pre-loaded over-center mechanism are housed, and a C-shaped projection projecting away from the housing.

9. The attachment assembly according to claim 8, wherein the conically tapered missile component interface surface is disposed on an outer circumferential side of the C-shaped projection.

10. The attachment assembly according to claim 8, wherein the housing of the missile component attachment interface includes a pivot pin guide hole along which at least one pivot pin of the series of pivoting arms is configured to slide.

11. The attachment assembly according to claim 8, wherein the housing of the missile component attachment interface includes an engagement drive hole for accessing the rotatable engagement drive from an exterior of the housing.

12. The attachment assembly according to claim 8, wherein the missile body attachment interface includes an engagement rod support structure arranged concentrically within the annular projection and projecting away from the missile body mount in the projecting direction.

13. The attachment assembly according to claim 12, wherein the engagement rod support structure is configured to support the engagement rod such that it extends perpendicular to the projecting direction.

14. The attachment assembly according to claim 12, wherein the missile body attachment interface includes a stabilizing key projecting perpendicularly out from the engagement rod support structure.

15. The attachment assembly according to claim 14, wherein the housing of the missile component attachment interface includes a keyhole into which the stabilizing key of the missile body attachment interface fits when the missile component attachment interface is interfaced with the missile body attachment interface.

16. A missile component attachment interface of a missile component for attachment to a missile body attachment interface of a missile body, the missile component attachment interface comprising:

a conically tapered missile component interface surface configured to be wedged against a conically tapered missile body interface surface of the missile body attachment interface;

an auto-adjusting assembly having a series of pivoting arms linearly connected to each other, the series of pivoting arms pivotably connected to an engagement drive at a first end thereof and a hook at a second end thereof, the auto-adjusting assembly movable between a first position in which the hook is unengaged with an engagement rod of the missile body attachment interface and a second position in which the hook is engaged and unlocked with the engagement rod, and between the second position and a third position in which the hook is engaged and locked with the engagement rod; and a pre-loaded over-center mechanism operably coupled to the auto-adjusting assembly and configured to lock the hook in engagement with the engagement rod in the third position.

17. A method of attaching a missile component to a missile body, wherein the missile body includes a missile body attachment interface having a conically tapered missile body interface surface and an engagement rod, and wherein the missile component includes a missile component attachment interface having a conically tapered missile component interface surface, an auto-adjusting assembly having a series of pivoting arms linearly connected to each other, the series of pivoting arms pivotably connected to an engagement drive at a first end thereof and a hook at a second end thereof, and a pre-loaded over-center mechanism operably coupled to the auto-adjusting assembly, the method comprising the steps of:

wedging the conically tapered missile component interface surface against the conically tapered missile body interface surface;

moving the auto-adjusting assembly of the missile component attachment interface from a first position in which the hook is unengaged with the engagement rod, to a second position in which the hook is engaged and unlocked with the engagement rod; and further moving the auto-adjusting assembly from the second position to a third position in which the hook is engaged and locked with the engagement rod;

wherein the further moving includes locking, with the pre-loaded over-center mechanism, the hook in engagement with the engagement rod in the third position.

18. The method according to claim 17, wherein the moving the auto-adjusting assembly of the missile component attachment interface from the first position to the second position includes rotating the rotatable engagement drive in a first direction.

19. The method according to claim 17, wherein the further moving the auto-adjusting assembly from the second position to the third position includes further rotating the rotatable engagement drive in the first direction.

20. A method of detaching the missile component attached to the missile body with the method according to claim 17, the method of detaching comprising:

reversing, by rotating the engagement drive in a second direction opposite the first direction, the auto-adjusting assembly from the third position to the second position, and further reversing, by further rotating the engagement drive in the second direction, the auto-adjusting assembly from the second position to the first position, wherein the reversing the auto-adjusting assembly from the third position to the second position includes unlocking, with the pre-loaded over-center mechanism, the hook from engagement with the engagement rod in the third position.

* * * * *